US009864309B2

(12) United States Patent
Tokuyama

(10) Patent No.: US 9,864,309 B2
(45) Date of Patent: Jan. 9, 2018

(54) TRANSFER DEVICE AND IMAGE FORMING APPARATUS

(71) Applicant: FUJI XEROX CO., LTD., Tokyo (JP)

(72) Inventor: Atsuhito Tokuyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/251,702

(22) Filed: Aug. 30, 2016

(65) Prior Publication Data

US 2017/0277084 A1 Sep. 28, 2017

(30) Foreign Application Priority Data

Mar. 25, 2016 (JP) ..... 2016-061179

(51) Int. Cl.
*G03G 15/16* (2006.01)

(52) U.S. Cl.
CPC ..... *G03G 15/1665* (2013.01)

(58) Field of Classification Search
CPC combination set(s) only.
See application file for complete search history.

(56) References Cited

U.S. PATENT DOCUMENTS

2007/0008395 A1* 1/2007 Masubuchi ..... G03G 15/0131 347/104
2010/0278567 A1* 11/2010 Nakagawa ..... G03G 15/1605 399/310

FOREIGN PATENT DOCUMENTS

JP 2007-286382 A 11/2007
JP 2007-316427 A 12/2007

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A transfer device includes a transfer member to which a bias voltage is applied and that transfers a toner image, which is carried on an image carrier, onto a sheet while nipping the sheet between the transfer member and the image carrier when the sheet is transported to the transfer member; and a pressing member that includes a spring member and a first rubber damper, which are arranged in series with each other, and that presses the transfer member against the image carrier.

12 Claims, 5 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2016-061179 filed Mar. 25, 2016.

BACKGROUND

Technical Field

The present invention relates to a transfer device and an image forming apparatus.

SUMMARY

According to an aspect of the invention, a transfer device includes a transfer member to which a bias voltage is applied and that transfers a toner image, which is carried on an image carrier, onto a sheet while nipping the sheet between the transfer member and the image carrier when the sheet is transported to the transfer member; and a pressing member that includes a spring member and a first rubber damper, which are arranged in series with each other, and that presses the transfer member against the image carrier.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described.

Figure 1:
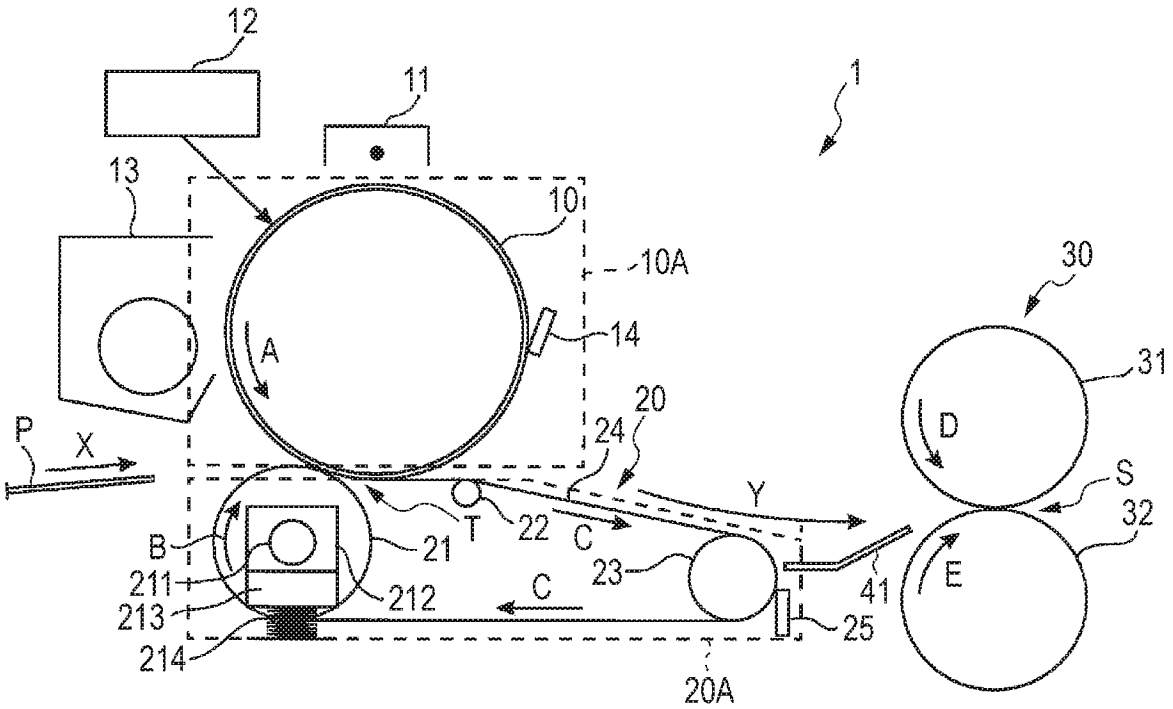
FIG. 1 is a schematic view of an image forming apparatus according to a first exemplary embodiment of the present invention.

FIG. 1 is a schematic view of an image forming apparatus 1 according to a first exemplary embodiment of the present invention. The image forming apparatus 1 illustrated in FIG. 1 includes a transfer device 20 according to the first exemplary embodiment of the present invention.

The image forming apparatus 1 includes a photoconductor drum 10. The photoconductor drum 10 is rotatably supported by a drum support frame 10A and rotates in the direction of arrow A. A charger 11, an exposure unit 12, and a developing unit 13 are disposed around the photoconductor drum 10. A toner image is formed on the surface of the photoconductor drum 10 through charging, exposure, and development processes; and the toner image is temporarily carried on the photoconductor drum 10.

One of sheets P, which are stacked on a sheet tray (not shown), is transported in the direction of arrow X and passes through a transfer region T between the photoconductor drum 10 and the transfer device 20 (described below in detail). While the sheet P passes through the transfer region T, the toner image on the photoconductor drum 10 is transferred onto the sheet P. The sheet P, to which the toner image has been transferred, is further transported in the direction of arrow Y and fed into a fixing device 30. The fixing device 30 includes a heating roller 31, which rotates in the direction of arrow D, and a pressing roller 32, which rotates in the direction of arrow E. The heating roller 31 and the pressing roller 32 contact each other to form a fixing region S. The sheet P, which has been transported in the direction of arrow Y, enters the fixing region S. While the sheet P passes through the fixing region S, the sheet P is heated and pressed, and the toner image on the sheet P is fixed onto the sheet P.

After the toner image has been transferred in the transfer region T, residual toner remains on the photoconductor drum 10. A cleaner 14 removes the residual toner from the photoconductor drum 10.

The transfer device 20 includes a transfer roller 21; a press-contact roller 22; a peel-off roller 23; and a transfer belt 24, which is an endless belt looped over these rollers. The transfer roller 21, the press-contact roller 22, and the peel-off roller 23 are rotatably supported by a transfer-unit support frame 20A.

The transfer roller 21 is an elastic roller whose roller surface is elastically deformable. The transfer roller 21 rotates in the direction of arrow B and drives the transfer belt 24. The transfer belt 24 is driven by the transfer roller 21 and rotates in the direction of arrow C. The transfer roller 21 is located upstream of the rotation axis of the photoconductor drum 10 in the sheet transport direction and presses the transfer belt 24 against the photoconductor drum 10 from the inside of the transfer belt 24. The transfer roller 21 defines an upstream edge of the transfer region T, in which the photoconductor drum 10 and the transfer belt 24 are in contact to each other.

The press-contact roller 22 is located downstream of the rotation axis of the photoconductor drum 10 in the sheet transport direction and presses the transfer belt 24 upward toward the photoconductor drum 10 from the inside of the transfer belt 24. The press-contact roller 22 defines a downstream edge of the transfer region T.

The diameter of the peel-off roller 23 is smaller than that of the transfer roller 21. The peel-off roller 23 sharply changes the direction in which the transfer belt 24 moves, so that the leading end of the sheet P on the transfer belt 24 is peeled off the transfer belt 24. The sheet P, which has been peeled off the transfer belt 24, is guided by a guide member 41 and moves in the direction of arrow Y. Then, as described above, while the sheet P passes through the fixing region S of the fixing device 30, a toner image is fixed onto the sheet P. Thus, an image, which is a fixed toner image, is formed on the sheet P. The sheet P, on which the image has been formed, is output onto a sheet output tray (not shown).

The transfer device 20 further includes a cleaner 25. The cleaner 25 removes toner and other substances adhering to the transfer belt 24 from the transfer belt 24.

The transfer roller 21 is connected to a power supply (not shown) that applies a transfer voltage to the transfer roller 21. Due to the effect of the transfer bias, a toner image on the photoconductor drum 10 is transferred onto the sheet P while the sheet P passes through the transfer region T.

Figure 2:
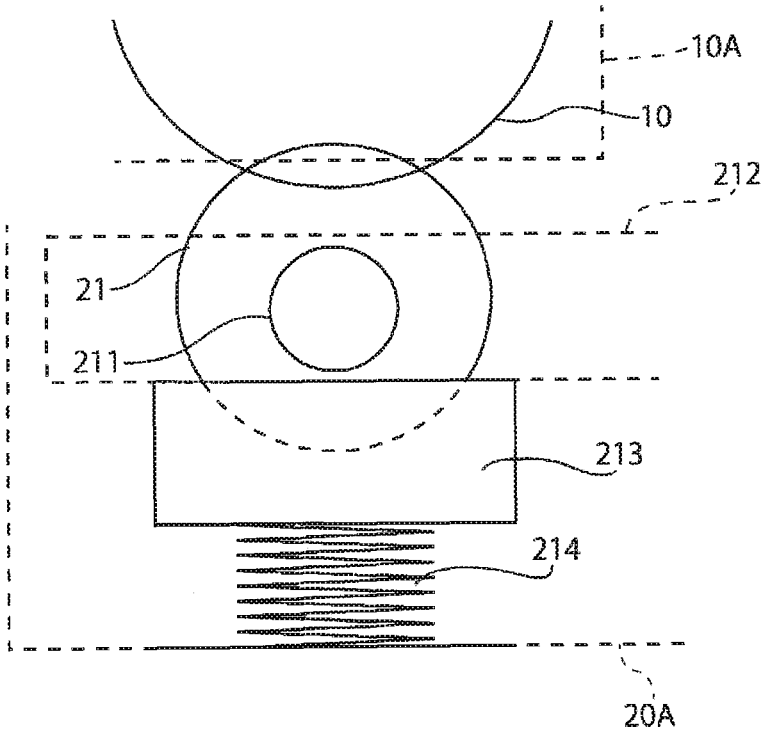
FIG. 2 is an enlarged schematic view of a region around a transfer roller according to the first exemplary embodiment shown in FIG. 1.

FIG. 2 is an enlarged schematic view of a region around the transfer roller 21 according to the first exemplary embodiment shown in FIG. 1. In FIG. 2, some elements, such as the transfer belt 24, are not illustrated.

The transfer roller 21 includes a rotary shaft 211, which is rotatably supported by a shaft support frame 212. The shaft support frame 212 is supported by the transfer-unit support frame 20A (see FIG. 1), which supports the entirety of the transfer device 20, in such a manner that the shaft support frame 212 is vertically movable.

In the region shown in FIG. 2A, a rubber damper 213 and a spring member 214 are arranged in series with each other. The spring member 214, whose lower end is fixed to the transfer-unit support frame 20A, serves as a compression spring and presses the transfer roller 21 against the photoconductor drum 10 via the rubber damper 213 and the shaft support frame 212. In the present exemplary embodiment, the transfer roller 21 is not directly pressed against the photoconductor drum 10, because the transfer belt 24 exists between the transfer roller 21 and the photoconductor drum 10.

The rubber damper 213 corresponds to an example of a first rubber damper in the present invention. The rubber damper 213 and the spring member 214 are disposed at each end of the transfer roller 21 in the axial direction. Therefore, the effect of the rubber damper 213 and the spring member 214 is exerted over the entire length of the transfer roller 21.

In FIG. 2, an upper end portion of the transfer roller 21 overlaps the photoconductor drum 10. This is because FIG. 2 illustrates the shape of the transfer roller 21 in a state in which no external force is applied to the transfer roller 21 and the transfer roller 21 is not deformed. In reality, the transfer roller 21, which is an elastic roller, deforms along the surface of the photoconductor drum 10.

The spring constant of the spring member 214 and the hardness of the rubber damper 213 will be examined below.

Figure 3:
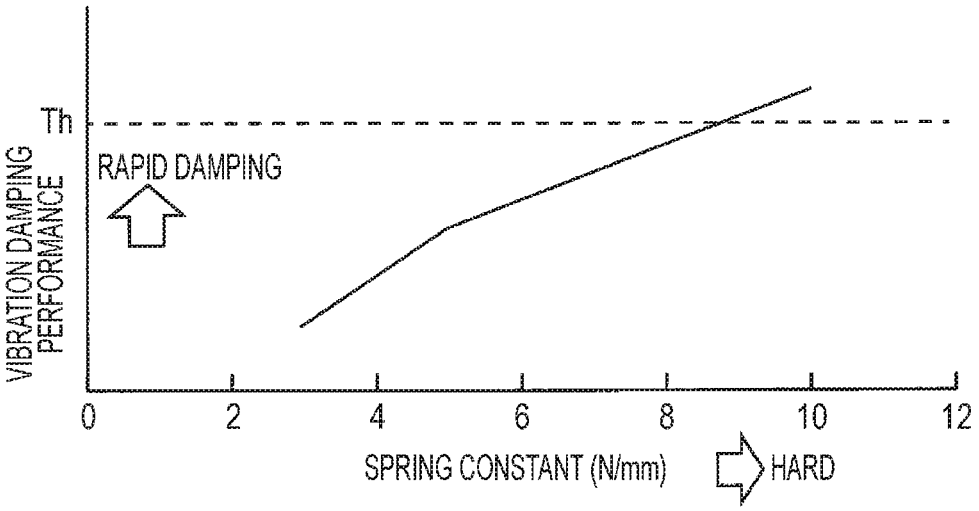
FIG. 3 is a graph representing the relationship between the spring constant (horizontal axis) of a spring member and the vibration damping performance (vertical axis) of the spring member in a case where a rubber damper is not used.

FIG. 3 is a graph representing the relationship between the spring constant (horizontal axis) of a spring member and the vibration damping performance (vertical axis) of the spring member in a case where a rubber damper is not used. Upward along the vertical axis, the vibration damping performance increases, that is, vibration is damped more rapidly. The threshold Th represents a target vibration damping performance, which is predetermined.

In the image forming apparatus 1 according to the present exemplary embodiment, the sheet feed speed is in the range of 400 mm/sec to 600 mm/sec, and the maximum thickness of a usable sheet is 0.4 mm. FIG. 3 is a graph representing data obtained by using a sheet having a thickness of 0.4 mm (the maximum thickness) under this condition. The same applies to FIG. 4 (described below).

FIG. 3 shows that, in order to obtain the target vibration damping performance by using only the spring member 214 and without using the rubber damper 213, it is necessary that the spring member 214 have a spring constant of about 8.7 N/mm or greater. In this case, although the target vibration damping performance is satisfied, a high contact pressure is applied to the photoconductor drum 10. Therefore, the photoconductor drum 10 may wear rapidly, and the life of the photoconductor drum 10 may be shortened. Moreover, because the contact pressure is high, a sheet may be temporarily stopped when the leading end of the sheet enters the inlet of the transfer region T, and therefore displaced image transfer may occur.

Figure 4:
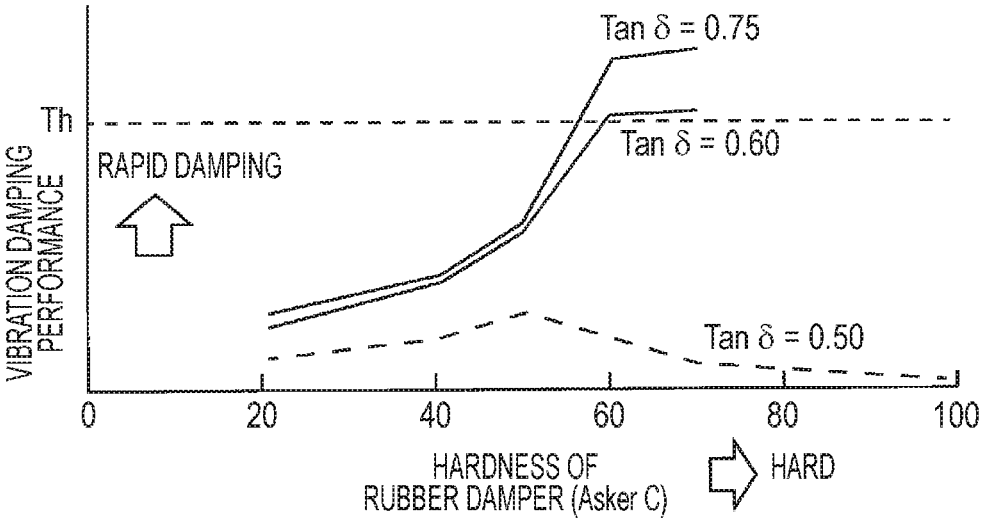
FIG. 4 is a graph representing the relationship between the Asker C hardness of a rubber damper (horizontal axis) and the vibration damping performance (vertical axis) of the rubber damper and the spring member.

FIG. 4 is a graph representing the relationship between the Asker C hardness of a rubber damper (horizontal axis) and the vibration damping performance (vertical axis) of the rubber damper and the spring member.

The spring member 214 used in this example has a spring constant of 7 N/mm. The spring constant 7 N/mm is smaller than the spring constant 8.7 N/mm, with which the spring member 214 satisfies the predetermined vibration damping performance as shown in FIG. 3. FIG. 4 shows that, even when the spring member 214 having the spring constant 7 N/mm is used, it is possible to obtain a vibration damping performance exceeding the threshold Th by using, as the rubber damper 213, a rubber damper having an Asker C hardness of 60° or more and 70° or less and an internal damping coefficient Tan δ of 0.60 or more and 0.75 or less. In this case, because the spring constant of the spring member 214 is reduced to 7 N/mm, a contact pressure applied to the photoconductor drum 10 is reduced. Therefore, an impact that occurs when the leading end of the sheet enters the fixing region S is reduced. As a result, displaced image transfer is prevented, and wear of the photoconductor drum 10 is suppressed. Thus, by using the rubber damper 213 in addition to the spring member 214, it is possible to achieve the target vibration damping performance while suppressing the occurrence of problems, such displaced image transfer and wear of the photoconductor drum 10. FIG. 4 also shows a result that, when a rubber damper having an internal damping coefficient Tan δ of 0.50 is used, the target vibration damping performance is not satisfied irrespective of the level of the Asker C hardness.

In the example described above, the spring member 214 having the spring constant 7 N/mm is used. Also when the spring member 214 having the spring constant of 8 N/mm is used, the spring member 214 alone does not satisfy the target vibration damping performance. However, by using the rubber damper 213 described above in addition to the spring member 214, the target vibration damping performance is satisfied while suppressing the negative effect of high contact pressure.

In the example described above, the rubber damper 213 is disposed adjacent to the transfer roller 21, and the spring member 214 is fixed to the transfer-unit support frame 20A. Conversely, the spring member 214 may be disposed adjacent to the transfer roller 21, and the rubber damper 213 may be fixed to the transfer-unit support frame 20A.

Description of the first exemplary embodiment of the present invention has been finished. Next, a second exemplary embodiment of the present invention will be described.

Figure 5:
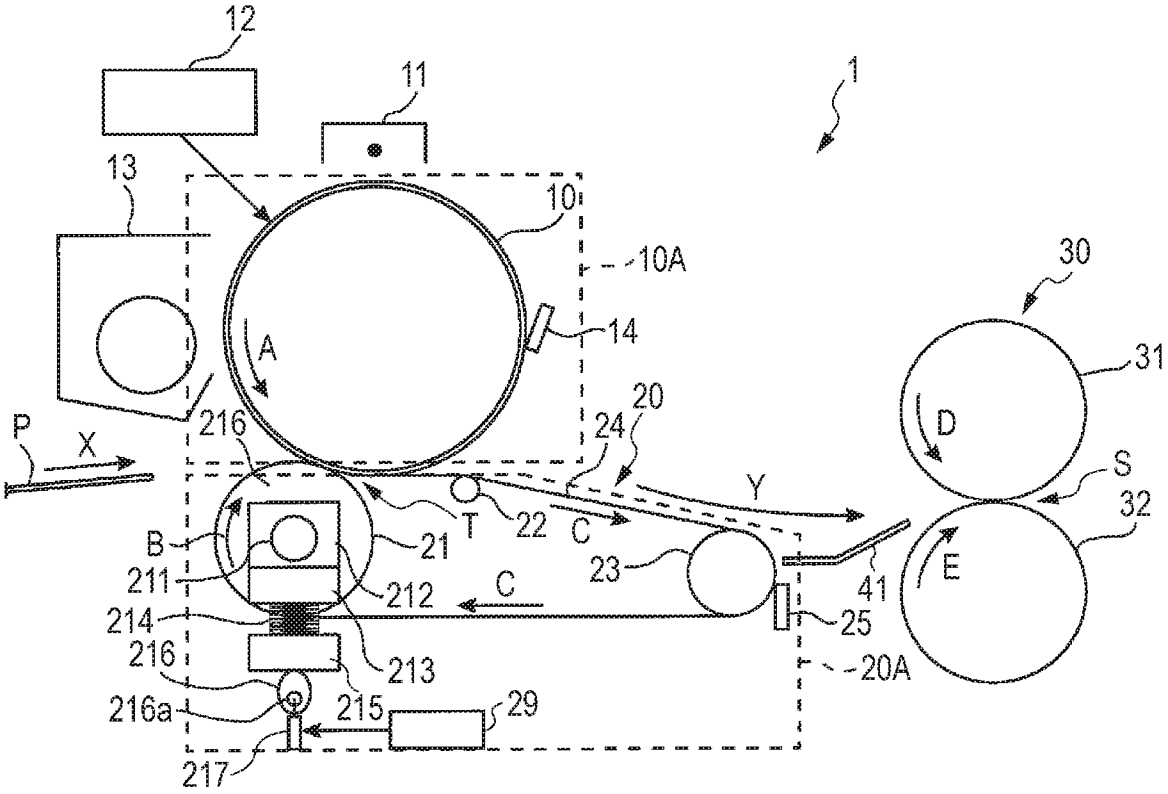
FIG. 5 is a schematic view of an image forming apparatus according to a second exemplary embodiment of the present invention.

FIG. 5 is a schematic view of an image forming apparatus 1 according to a second exemplary embodiment of the present invention. The image forming apparatus illustrated in FIG. 5 includes a transfer device 20 according to the second exemplary embodiment of the present invention.

Figure 6:
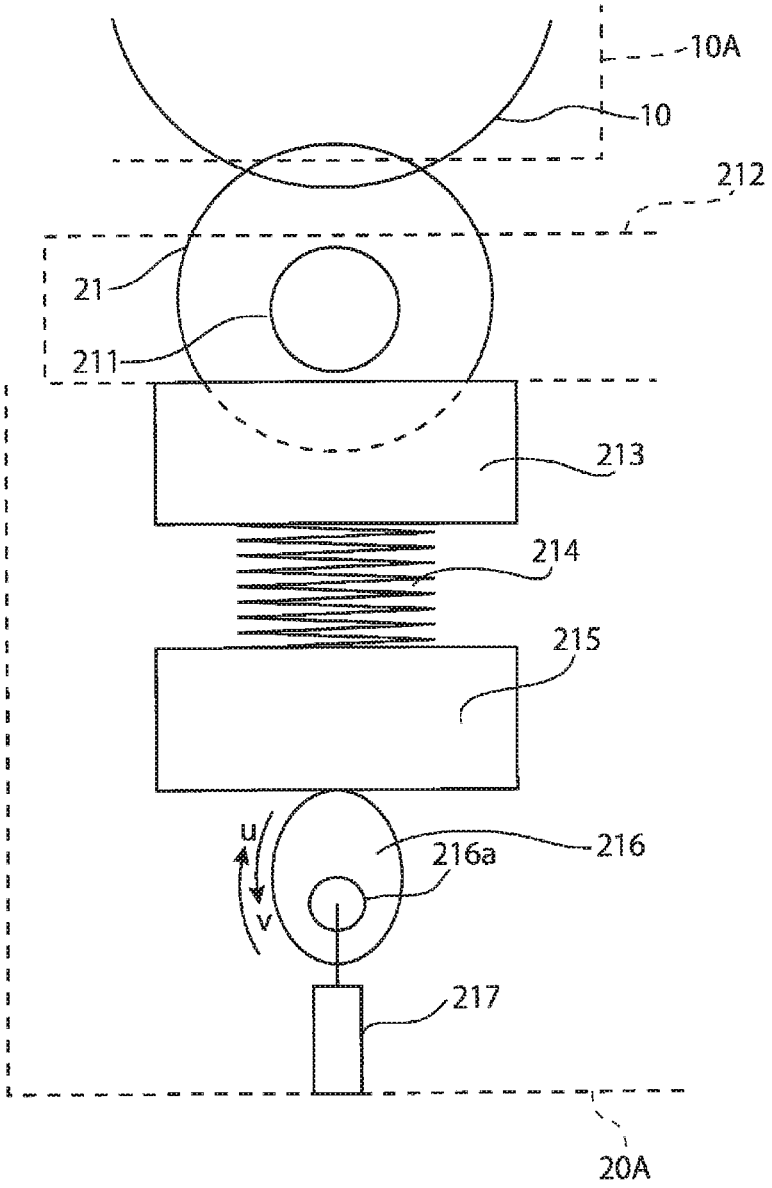
FIG. 6 is an enlarged schematic view of a region around a transfer roller according to the second exemplary embodiment shown in FIG. 5.

FIG. 6 is an enlarged schematic view of a region around a transfer roller 21 according to the second exemplary embodiment shown in FIG. 5. In FIG. 6, as with FIG. 2, some elements, such as a transfer belt 24, are not illustrated.

FIG. 5 and FIG. 6 respectively correspond to FIG. 1 and FIG. 2 for the first exemplary embodiment. Elements that are the same as those of the first exemplary embodiment will be denoted by the same numerals as those in FIG. 1 and FIG. 2, and only the differences from the first exemplary embodiment will be described.

The developing device according to the second exemplary embodiment further includes a rubber damper 215, in addition to the rubber damper 213 and the spring member 214 in the first exemplary embodiment. The rubber damper 215 is disposed at such a position that the spring member 214 is located between the rubber damper 213 and the rubber damper 215. The rubber damper 215 corresponds to an example of a second rubber damper in the present invention.

The developing device according to the second exemplary embodiment further includes a cam member 216. The cam member 216 corresponds to an example of a pressing-force control member in the present invention. The cam member 216 presses a serial body including the rubber damper 213, the spring member 214, and the rubber damper 215 toward the photoconductor drum 10 with a variable pressing force.

A motor 217 rotates the cam member 216 around a rotary shaft 216*a* back and force in the directions of arrows u and v (see FIG. 6) by half turns. The motor 217 rotates or stops in accordance with instruction from a controller 29 (see FIG. 5). The rotary shaft 216*a* of the cam member 216 is rotatably supported by the transfer-unit support frame 20A. When the cam member 216 rotates in the direction of arrow u, the spring member 214 is strongly pressed in such a direction that the transfer roller 21 is pressed against the photoconductor drum 10. FIG. 6 illustrates a state in which the spring member 214 is pressing the transfer roller 21 most strongly.

Also in the second exemplary embodiment, as in the first exemplary embodiment described above, a serial body including the rubber damper 213, the spring member 214, and the rubber damper 215, and the cam member 216 are disposed at each end of the transfer roller 21 in the axial direction. Therefore, the effect of these members is exerted over the entire length of the transfer roller 21.

The cam member 216 is rotated by the motor 217, which receives instruction from the controller 29, as follows.

Before the sheet P reaches the transfer region T illustrated in FIG. 1, the cam member 216 is rotated in the direction of arrow v, so that a pressing force with which the transfer roller 21 presses the photoconductor drum 10 is reduced. In this state, the transfer roller 21 is weakly pressed against the photoconductor drum 10 with the transfer belt 24 therebetween. Accordingly, a decrease of image quality, which may occur due to an impact that occurs when the leading end of the sheet P enters the transfer region T, is suppressed. When the sheet P has entered the transfer region T, the cam member 216 is rotated in the direction of arrow u, so that the transfer roller 21 is strongly pressed against the photoconductor drum 10 via the spring member 214.

Here, it is assumed that the sheet P, on which an image is to be formed in this example, is a long sheet having such a length that the leading end of the sheet P enters the fixing region S while a part of the sheet P still remains in the transfer region T. In the image forming apparatus 1, the distance between the transfer region T and the fixing region S is about 230 mm. If the size of the sheet P is not larger than A4, the leading end of the sheet P enters the fixing region S after the trailing end of the sheet P has exited the transfer region. However, if an A3-sized sheet is transported in its longitudinal direction, the trailing end of the sheet still remains in the transfer region T when the leading end of the sheet enters the fixing region S. In this case, transfer of a toner image is still being performed at a timing at which the leading end of the sheet enters the fixing region S. Therefore, if an impact that occurs when the leading end of the sheet enters the fixing region S is transmitted and the transfer roller 21 vibrates, a decrease of image quality due to transfer failure may occur.

In the second exemplary embodiment, the rubber damper 215 is made of a material whose property is adjusted to be suitable for damping vibration due to an impact that occurs when the leading end of the sheet enters the fixing region S. Accordingly, the rubber damper 215 effectively damps vibration due to an impact that occurs when the leading end of the sheet enters the fixing region S. That is, with the second exemplary embodiment, the rubber damper 213 effectively damps the vibration due to an impact that occurs when the leading end of the sheet enters the transfer region T, and the rubber damper 215 effectively damps the vibration due to an impact that occurs when the leading end of the sheet enters the fixing region S, and therefore a decrease of image quality, which may be caused by each impact, is suppressed.

In the example described above, the transfer device 20 is a belt-transfer-type transfer device including the transfer belt 24. However, the present invention is also applicable to a contact-type transfer device that does not include a transfer belt and in which a transfer roller directly contacts the photoconductor drum 10.

In the exemplary embodiments described above, the photoconductor drum 10 is used as an example of an image carrier in the present invention. However, the present invention is also applicable to a case where an intermediate transfer member, to which a toner image is first-transferred from a photoconductor drum and from which the toner image is second-transferred onto a sheet, is used as an example of an image carrier in the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer member to which a bias voltage is applied and configured to transfer a toner image, which is carried on an image carrier, onto a sheet while nipping the sheet between the transfer member and the image carrier in response to the sheet being transported to the transfer member; and a pressing member comprising a spring member and a first rubber damper, which are arranged in series with each other, the pressing member being configured to press the transfer member against the image carrier, wherein the first rubber damper has an Asker hardness of 60° or more and 70° or less and an internal damping coefficient Tan δ of 0.60 or more and 0.75 or less.

2. The transfer device according to claim 1, wherein the spring member has a spring constant that is less than a spring constant that satisfies a predetermined vibration damping performance.

3. The transfer device according to claim 2, wherein the spring member has a spring constant of 7 N/mm or more and 8 N/mm or less.

4. The transfer device according to claim 3,
wherein the pressing member further comprises:
a second rubber damper that is disposed in series with the first rubber damper and the spring member at such a position that the spring member is located between the first rubber damper and the second rubber damper, and
a pressing-force control member configured to press a serial body including the first rubber damper, the spring member, and the second rubber damper against the image carrier with a variable pressing force.

5. The transfer device according to claim 4,
further comprising a fixing device configured to fix the toner image, which has been transferred onto the sheet, onto the sheet,
wherein the first rubber damper is configured to damp a vibration that occurs when a leading end of the sheet enters a transfer region, and
wherein the second rubber damper is configured to damp a vibration that occurs when a leading end of the sheet enters a fixing region.

6. The transfer device according to claim 2,
wherein the pressing member further comprises:
a second rubber damper that is disposed in series with the first rubber damper and the spring member at such a position that the spring member is located between the first rubber damper and the second rubber damper, and
a pressing-force control member configured to press a serial body including the first rubber damper, the spring member, and the second rubber damper against the image carrier with a variable pressing force.

7. The transfer device according to claim 6,
further comprising a fixing device configured to fix the toner image, which has been transferred onto the sheet, onto the sheet,
wherein the first rubber damper is configured to damp a vibration that occurs when a leading end of the sheet enters a transfer region, and
wherein the second rubber damper is configured to damp a vibration that occurs when a leading end of the sheet enters a fixing region.

8. The transfer device according to claim 1, further comprising:
a press-contact roller provided downstream of the transfer member in a sheet transport direction;
a peel-off roller provided downstream of the press-contact roller in the sheet transport direction; and
a transfer belt entrained around the transfer member, the press-contact roller, and the peel-off roller.

9. The transfer device according to claim 1,
wherein the transfer member comprises:
a rotary shaft; and
a shaft support frame supporting the rotary shaft,
wherein the pressing member is configured to press the shaft support frame.

10. A transfer device comprising:
a transfer member to which a bias voltage is applied and configured to transfer a toner image, which is carried on an image carrier, onto a sheet while nipping the sheet between the transfer member and the image carrier in response to the sheet being transported to the transfer member; and
a pressing member comprising a spring member and a first rubber damper, which are arranged in series with each other, the pressing member being configured to press the transfer member against the image carrier,
wherein the pressing member further comprises:
a second rubber damper that is disposed in series with the first rubber damper and the spring member at such a position that the spring member is located between the first rubber damper and the second rubber damper, and
a pressing-force control member configured to press a serial body including the first rubber damper, the spring member, and the second rubber damper against the image carrier with a variable pressing force.

11. The transfer device according to claim 10,
further comprising a fixing device configured to fix the toner image, which has been transferred onto the sheet, onto the sheet,
wherein the first rubber damper is configured to damp a vibration that occurs when a leading end of the sheet enters a transfer region, and
wherein the second rubber damper is configured to damp a vibration that occurs when a leading end of the sheet enters a fixing region.

12. An image forming apparatus comprising:
an image carrier configured to carry a toner image formed thereon;
a transfer device configured to transfer the toner image on the image carrier onto a sheet;
a fixing device configured to fix the toner image, which has been transferred onto the sheet, onto the sheet; and
a sheet transport unit configured to transport the sheet along a transport path that passes through a transfer position at which the transfer device is configured to transfer the toner image onto the sheet and a fixing position at which the fixing device is configured to fix the toner image onto the sheet,
wherein the transfer device comprises:
a transfer member to which a bias voltage is applied and configured to transfer the toner image, which is carried on the image carrier, onto the sheet while nipping the sheet between the transfer member and the image carrier in response to the sheet being transported to the transfer member, and
a pressing member comprising a spring member and a first rubber damper, which are arranged in series with each other, the pressing member being configured to press the transfer member against the image carrier,
wherein the first rubber damper has an Asker hardness of 60° or more and 70° or less and an internal damping coefficient Tan δ of 0.60 or more and 0.75 or less.

* * * * *